US005728195A

United States Patent [19]

Eastman et al.

[11] Patent Number: 5,728,195

[45] Date of Patent: Mar. 17, 1998

[54] METHOD FOR PRODUCING NANOCRYSTALLINE MULTICOMPONENT AND MULTIPHASE MATERIALS

[75] Inventors: Jeffrey A. Eastman, Woodridge; Mindy N. Rittner, Des Plaines; Carl J. Youngdahl, Westmont; Julia R. Weertman, Evanston, all of Ill.

[73] Assignee: The United States of America as represented by the Department of Energy, Washington, D.C.

[21] Appl. No.: 801,672

[22] Filed: Feb. 18, 1997

Related U.S. Application Data

[63] Continuation of Ser. No. 402,999, Mar. 10, 1995, abandoned.

[51] Int. Cl.[6] ..... B22F 1/00; B22F 9/00

[52] U.S. Cl. ..... 75/351; 264/430; 264/434

[58] Field of Search ..... 264/430, 434; 75/351

[56] References Cited

U.S. PATENT DOCUMENTS

| | | | |
|---|---|---|---|
| 4,533,383 | 8/1985 | Miura et al. | 75/351 |
| 5,128,081 | 7/1992 | Siegel et al. | 264/81 |
| 5,223,186 | 6/1993 | Eastman et al. | 264/81 |

OTHER PUBLICATIONS

Eastman, et al. "Synthesis of Nanophase Materials By Electron Beam Evaporation" NanoStructed Materials vol. 2 pp. 377–382.

Eastman "Electron Beam Synthesis Nanophase Materials in Inert and Reactive Gases", Invited Talk, Engineering Conference (1994) (2 pgs).

Niedzielka et al., "Nanocrystalline Aluminum–Zirconium Alloys", Engineering Foundation Conference (Mar. 12, 1994). 2 pgs.

Rittner et al., "Synthesis and Properties Studies of Nanocrystalline AL–$Z1_3Zr$", Scipts Metallurgies of Materials vol. 31 pp. 841–846 (May 1994) (6 pgs).

Youngdahl et al., "Synthesis of Metal–Oxide Nanocomposites", Materials Research Society (Nov. 1994) (4 pgs).

*Primary Examiner*—Christopher A. Fiorilla
*Attorney, Agent, or Firm*—Joy Alwan; Thomas G. Anderson; William R. Moser

[57] ABSTRACT

A process for producing multi-component and multiphase nanophase materials is provided wherein a plurality of elements are vaporized in a controlled atmosphere, so as to facilitate thorough mixing, and then condensing and consolidating the elements. The invention also provides for a multicomponent and multiphase nanocrystalline material of specified elemental and phase composition having component grain sizes of between approximately 1 nm and 100 nm. This material is a single element in combination with a binary compound. In more specific embodiments, the single element in this material can be a transition metal element, a non-transition metal element, a semiconductor, or a semimetal, and the binary compound in this material can be an intermetallic, an oxide, a nitride, a hydride, a chloride, or other compound.

12 Claims, 3 Drawing Sheets

METHOD FOR PRODUCING NANOCRYSTALLINE MULTICOMPONENT AND MULTIPHASE MATERIALS

This is a continuation of application Ser. No. 08/402,999 filed Mar. 10, 1995, now abandoned.

CONTRACTUAL RIGHTS IN THE INVENTION

The United States has contractual rights in this invention pursuant to contract No. W-31-109-ENG-38 between the U.S. Department of Energy and the University of Chicago representing Argonne National Laboratory, and under Grant Number DE-FG02-86ER45229 between the U.S. Department of Energy and Northwestern University. The Aluminum Company of America, through award number PO TC924977TC, also sponsored research which led to this patent application.

BACKGROUND OF THE INVENTION

1. Field of the Invention

This invention relates to nanocrystalline materials and a method for producing nanocrystalline materials and more specifically this invention relates to nanocrystalline materials having components with predetermined sizes and in predetermined weight ratios that confer superior mechanical characteristics, and a method for producing these mechanically superior nanocrystalline materials.

2. Background of the Invention

The term nanocrystalline, or nanophase, materials refers to solids containing crystallites of approximately 1–100 nm in diameter. Much of the research to date on this relatively new class of materials has been aimed at elucidating the microstructure and properties of pure metals and oxides. The interest in these materials has stemmed from the fact that they are relatively easy to produce and useful as model systems. However, the development of a method to produce more complex multicomponent and multiphase nanocrystalline systems is of industrial significance. For example, there is industrial interest in the development of alloys of transition metals having high specific strengths that can be exploited in elevated temperature applications. The strengthening of these alloys can be attributed to a dispersion of second phase particles that inhibit dislocation motion. In order to produce alloys that are strong enough for current and future applications, the development of new synthesis techniques leading to materials with increased particle volume fractions is desired. It is also desired that these new materials exhibit grain size and phase stability at elevated temperatures.

Rapid solidification has been one method of developing alloys with refined microstructures and relatively large second phase volume fractions. Traditional internal oxidation methods create materials with hard ceramic (oxide) reinforcements embedded at the grain boundaries of larger softer crystals.

The conventional procedures outlined supra limit the concentration of minority phase in a multiphase alloy to that determined by the equilibrium phase diagram of the system in question. For example, the equilibrium solubility of Si in Cu is less than 15 atomic percent; therefore, synthesis of a Cu—$SiO_x$ two phase alloy by oxidation of the Si in a Cu—Si solid solution is limited to a maximum $SiO_x$:Cu mole fraction corresponding approximately to this solubility limit. For analogous reasons, the volume fraction of desirable second phase particles in the case of rapidly solidified Al—Zr—V alloys is limited to approximately 0.10.

Procedures of first producing ultra-pure powders in separate batch processes further requires mixing these powders in an additional step prior to sintering. In as much as many of the elements comprising the powders are oxidizable at ambient oxygen concentrations, this mixing and sintering has to be performed under vacuum conditions.

Resistive heating, the conventional evaporation technique for synthesis of nanocrystalline metals, has limited potential for the production of multicomponent nanphase materials. For example, resistive heating does not provide the ability to evaporate a wide variety of materials having high melting points or low vapor pressures. Often, reactive gases can not be used in the process. Lastly, cleanliness of the process is sacrificed, in as much as resistive heating techniques thermally treat both the material to be evaporated and the surrounding structures, potentially leading to oxidation of the evaporation source and contamination of the nanophase powder.

As such, processes to more efficiently produce these materials continue to elude researchers. Prior to the instant teaching, production of nanophase materials has been developed (U.S. Pat. No. 5, 128,081) to produce single component systems. However, such processes require a second step to facilitate the subsequent oxidation of said single metal components.

A need exists in the art for a process for producing ultra-pure multi-component nanoscale materials in an efficient manner whereby multiple production processes are avoided and grain sizes are minimized. Any subsequent sintering processes also should be operable at room temperatures for selected alloys.

SUMMARY OF THE INVENTION

It is an object of the present invention to provide a process to produce multi-component and multiphase nanophase materials that overcomes many of the disadvantages of the prior art.

It is another object of the present invention to provide a process for producing multi-component and multiphase nanoscale materials. A feature of the invention is the use of electron beam evaporation to separately vaporize components. An advantage of the invention is that the ratio of elemental species within the composite can be varied by independently controlling the crucible dwell times during evaporation processes.

Yet another object of the present invention is to provide a gas condensation process for producing nanophase composites of specified elemental and phase compositions. A feature of the invention is the use of electron beam evaporation in a controlled atmosphere to independently vaporize elements and subsequently form oxides or nitrides of the elements in a single step if desired. An advantage of the invention is the production of composites having controllable mechanical properties that are characteristic of specific component ratios.

Briefly, the invention provides for a process for producing multicomponent and multiphase nanophase materials comprising supplying a controlled atmosphere, enclosing a plurality of elements in said controlled atmosphere, simultaneously evaporating the elements in said controlled atmosphere so as to vaporize the elements, allowing the now vaporized elements to mix with each other in the controlled atmosphere, condensing the now mixed elements, removing the condensed elements from the controlled atmosphere, and consolidating the condensed elements. The invention also provides for a multicomponent and multiphase nanocrystalline material of predetermined elemental and phase composition having component grain sizes of between approximately 1 nm and 100 nm. In this embodiment this material comprises a single element in combination with a binary compound. In more specific embodiments, the single element in this material can be a transition metal element, a non-transition metal element, a semiconductor, or a semimetal, and the binary compound in this material can be an intermetallic, an oxide, a nitride, a hydride, a chloride, or other compound. In particular, the single element can be selected from titanium, iron, cobalt, nickel, iron, nickel, zinc, zirconium, palladium, silver, platinum, tungsten, molybdenum, chromium, magnesium, manganese, iridium, niobium, gold, copper, aluminum, silicon, and germanium. The binary compound can be selected from an intermetallic such as TiAl, $Ti_3Al$, NiAl, $Ni_3Al$, $Al_3Zr$, $TiSi_2$,$Ti_5Si_3$, NiTi, $MoSi_2$ and $Al_3Ti$ or from an oxide or a nitride of an element such as titanium, iron, cobalt, nickel, copper, zirconium, palladium, silver or platinum.

BRIEF DESCRIPTION OF THE DRAWING

These and other objects and advantages of the present invention will become readily apparent upon consideration of the following detailed description and attached drawing, wherein.

DETAILED DESCRIPTION OF THE INVENTION

Figure 1:
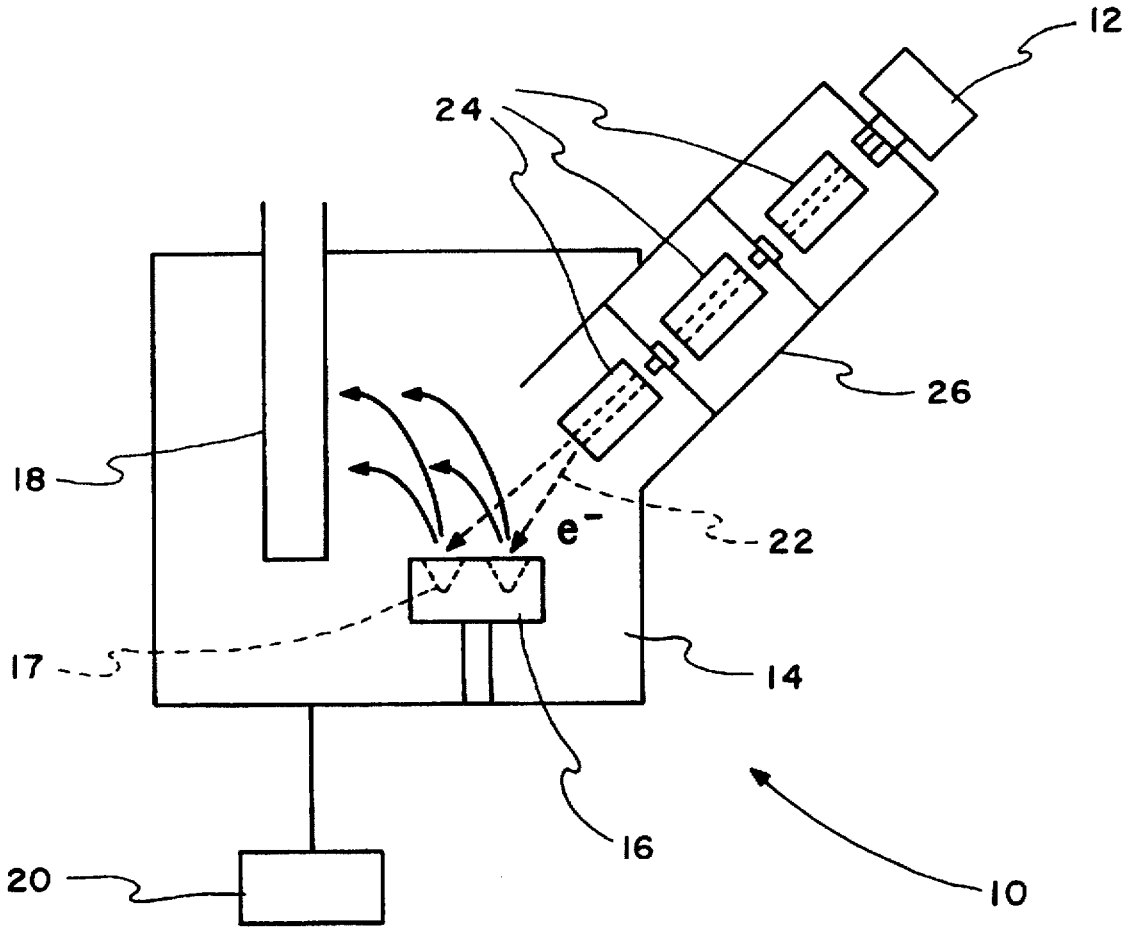
FIG. 1 is a schematic diagram of a method for producing nanocrystalline materials, in accordance with the features of the present invention.

A new nanophase material preparation system has been developed, whereby electron beam heating is used to vaporize materials in inert or reactive gaseous environments. A wide variety of materials in nanophase form are produced with this system, and with minimum contamination. An exemplary list of materials includes, but is not limited to, transition group metals such as titanium, iron, cobalt, nickel, copper, zirconium, palladium, silver, platinum, and gold. Oxides that can be produced include, but are not limited to, $ZrO_2$, $Al_2O_3$, $TiO_2$, NiO, $Y_2O_3$ and $Y_2O_3$—$ZrO_2$. Intermetallic materials which can e produced from the method include, but are not limited to, TiAl, NiAl, $Ni_3Al$, $Al_3Zr$ and alloys of aluminum and alloys of other metals, and composites of Cu and $SiO_x$.

Besides enabling the production of pure metals, including refractory materials, the system is designed to produce alloys and multi-component materials by simultaneous evaporation of two or more elements. The electron beam position and dwell time are set by computer, thereby allowing for greater control of evaporation conditions. A key feature of the invention is that at least one additional component is added in a one-step process while under condensation conditions to form multi-component nanophase materials.

The invention also provides for the production of nanocrystalline multicomponent materials containing intermetallic and/or oxide particles to provide materials of enhanced hardness and thermal stability. The strength of these materials is superior to those composites that are currently commercially prepared using the processes outlined supra. The strength of the new materials also are superior to single phase nanophase materials.

The invented process combines a feature of simultaneous evaporation of selected materials in a closed, controlled environment, having a predetermined partial pressure of reactive gas such as oxygen, nitrogen, hydrogen, methane, chlorine, or ammonia, depending on the final product desired, said partial pressure selected based on the reactivities of the components to be reacted.

The materials to be mixed are first evaporated. Evaporation can be effected by a variety of heating means, including an electron beam, RF heating, plasma heating or laser beam irradiation. Sputtering also may be used to obtain vaporization.

Upon collision with gas molecules in the closed environment, the materials condense back into solids. If oxide production is desired, however, and if one of the evaporated materials (e.g. silicon) has a higher affinity for the reactive gas (e.g. oxygen) than another evaporated component (e.g. copper), then oxide (e.g. $SiO_x$) formation occurs without formation of oxides of the other component. The two types of particles (e.g. $SiO_x$ and Cu-metal) arethen collected and later sintered.

Simultaneous evaporation of desired nanophase metals provides complete homogenous mixture of the materials that leads to phase mixtures that are unattainable with prior methods. The concentration of minority phase in a multiphase alloy produced by this evaporation method is not limited by the equilibrium phase diagram of the system in question.

Uses of the invented materials are numerous. Nanocrystalline metal-metal oxide and/or metal-intermetallic composites such as Al—$Al_3Zr$ may be incorporated into aircraft or automobile structural components. These composite materials might also be used in elevated temperature applications such as turbine engines. Yet another application is coatings for cutting tools such as drill bits.

An exemplary device embodying the process is depicted in FIG. 1 as numeral 10. Generally, an inert gas condensation process with electron beam evaporation is used to produce nanocrystalline materials. A voltage and current-controlled electron beam 22, generated in a $2\times10^{-6}$ Pa vacuum from a tungsten filament 12, is rastered on a millisecond time scale among several materials contained in separate crucibles 17, said crucibles integrally molded with a water-cooled copper hearth 16. The electron beam 22 is focused and translated by three pairs of focusing and deflection coils 24 longitudinally disposed along the differentially pumped column 26 leading from the tungsten filament 12 to the main chamber 14. The chamber is back-filled with a predetermined pressure of ultra-high purity inert gas, or predetermined partial pressures of reactive gas. Pressures can range from between approximately 0.1 torr and 2.0 torr and typically about 0.3 torr.

Upon evaporation, the materials travel as an evaporant plume by convection and adhere to a liquid nitrogen cooled plate or finger 18 to be collected as ultra-pure powders. These powders are then scraped into a funnel and transported under vacuum to a suitable consolidation unit 20 where the powders are compressed at about 1.4 GPa into dense (70–95+% of theoretical density) disks. Compaction is performed at a variety of temperatures, and more conveniently at room temperature for some materials, using the compaction unit 20. Sinter temperatures can range from room temperature (26° C.) to 400° C., depending on the material. For example, while aluminum and copper sinter at very low temperatures, zirconium-containing materials often require temperatures of approximately 300° C. A more detailed discussion of the inert gas condensation (IGC) process with electron beam heating is found in M. N. Rittner et al., Scripta Metall. 31,7, 841 (1994), incorporated herein by reference.

The above-described inert gas condensation method with electron beam heating has been used by the inventors to synthesize a myriad of different types of nanocrystalline multi-phase samples.

EXAMPLE 1

Nanocrystalline aluminum-zirconium alloys of various zirconium concentrations have been produced. These materials have been characterized using x-ray diffraction, Rutherford backscattering (RBS), and various microscopy techniques, including transmission electron microscopy (TEM), scanning electron microscopy (SEM) and x-ray energy dispersive spectroscopy (EDS). The hardness and thermal stability of the nanocrystalline Al—Zr alloys also have been investigated by Vickers microhardness measurements and TEM experiments at room and elevated temperatures.

The alloys contain nanocrystalline intermetallic $Al_3Zr$ uniformly embedded within samples composed primarily of nanocrystalline aluminum. The identification of the $Al_3Zr$ (cubic) structure as a second phase in these materials is significant because the particles retain small diameters (of approximately 10 nm)in conventional aluminum alloys even after exposure to 425° C. (0.75 Tm of aluminum for 1200 hours. The presence of this well-dispersed phase demonstrates that the aluminum and zirconium are mixing and reacting during the synthesis process, despite non-simultaneous evaporation and cooling, or condensation, of the two species. The elements are separated by approximately 1 cm in different crucibles of the hearth and the evaporated atoms have mean free paths far shorter than this distance; thus it is clear that pure aluminum and pure zirconium clusters form initially and subsequently react in the solid state to form $Al_3Zr$. The quantity of this phase produced is a function of the amount of zirconium evaporated during the synthesis process, and thus can be controlled.

Figure 2:
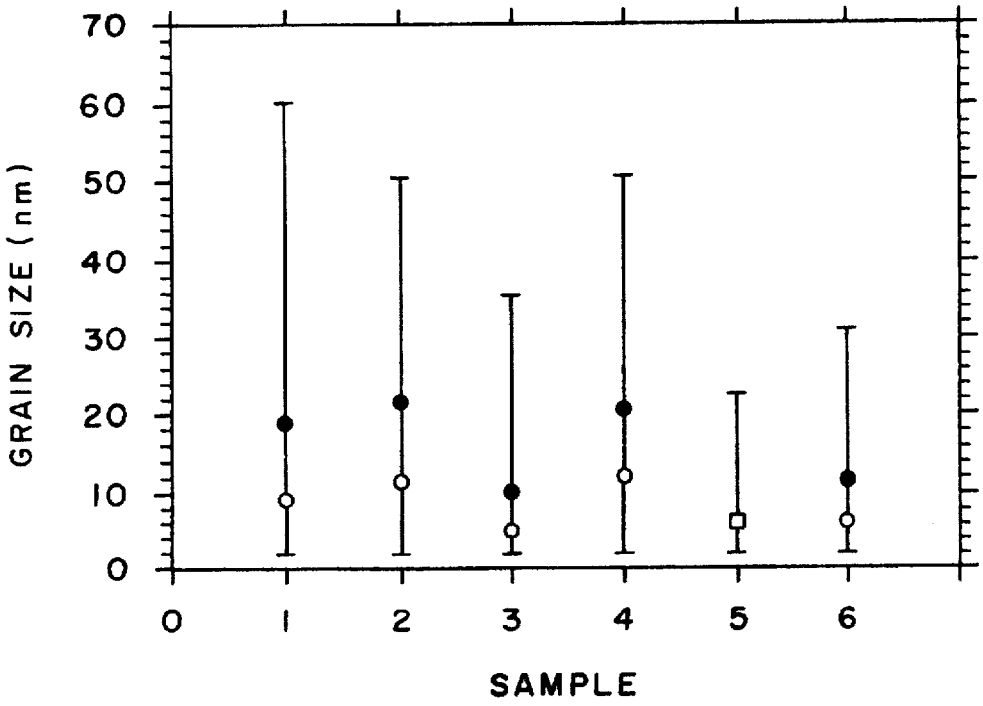
FIG. 2 is a graph depicting average grain sizes for components of nanocrystalline materials, in accordance with the features of the present invention.

FIG. 2 depicts the average grain sizes and grain size ranges for the aluminum matrix in nanocrystalline Al—Zr for a number of samples. The average grain size of all the specimens shown in FIG. 2 is <~20 nm, and is found to correlate with the evaporation rates of the component materials, as observed through changes in the chamber pressure during the evaporation process. The higher the evaporation rate, the larger the average grain size of the resulting samples. Thus, the average grain size and grain size distribution of the nanocrystalline samples can be controlled via adjustments in the machine variables (e.g., electron beam current, voltage, focus, and heating time) that affect the evaporation rates.

Figure 3:
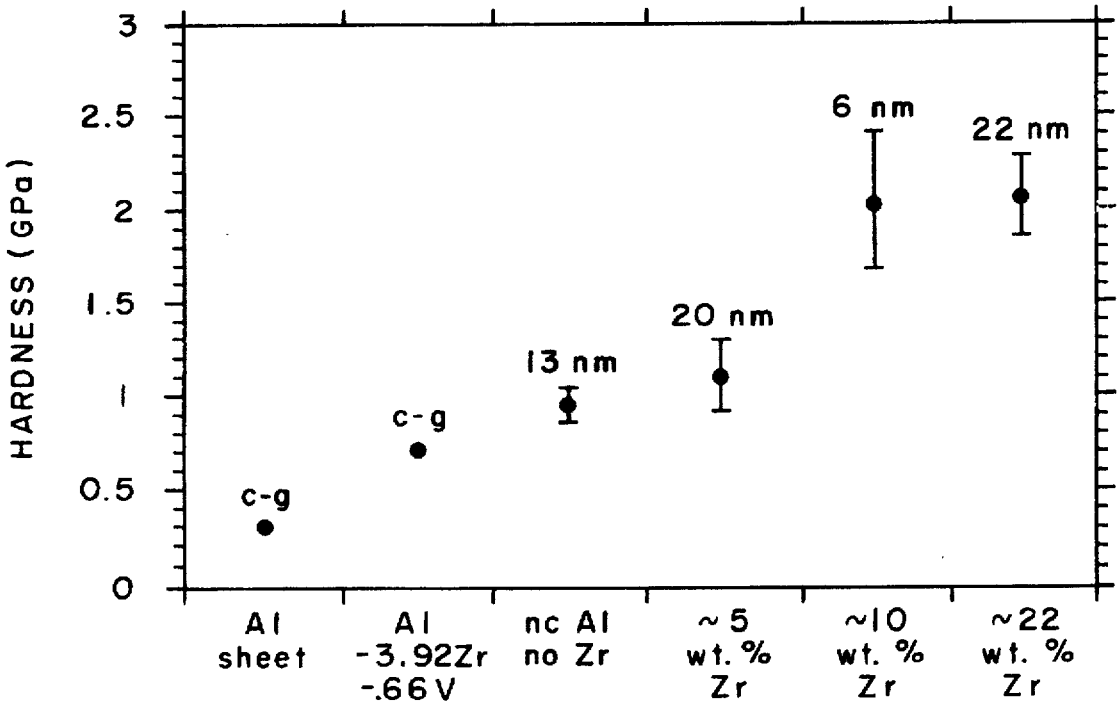
FIG. 3 is a graph depicting the relationship of grain size to hardness characteristics of nanocrystalline materials, in accordance with the features of the present invention.

Vickers microhardness data is illustrated in FIG. 3. A 100 gram load was applied for 20 seconds for a total of 10–20 measurements per sample. Up to six-fold increases in hardness have been found in the nanocrystalline Al—Zr alloys compared to coarse-grained aluminum, and up to approximately two-fold increases in hardness are observed when comparing multiphase Al—Zr nanocrystalline samples with nanocrystalline aluminum samples that do not contain zirconium. FIG. 3 illustrates that zirconium additions to nanocrystalline aluminum contribute to an increase in material hardness, as does the grain size reduction inherent in these materials.

It has also been found that significant grain coarsening (to 100+) nm at room temperature occurred in samples containing less than approximately 2 weight percent of zirconium. After being held at room temperature for approximately one year, samples having on average 13 and 35 weight percent of zirconium showed no signs of grain growth. Conversely, a nanocrystalline aluminum specimen containing no zirconium and about 1 weight percent of oxygen coarsened considerably with some grains growing to as large as 10—20 times their initial average size of 16 nm.

The nanocrystalline Al—Zr samples have exhibited stability at elevated temperatures as well, as demonstrated by preliminary TEM annealing experiments. Two samples containing on average 13 and 18 weight percent of zirconium retained their nanostructures during in-situ heating experiments to 0.72 and 0.79 Tm of aluminum. The observed stability is attributed to the presence of the $Al_3Zr$ cubic phase, although pores and any impurities (such as oxides) may also contribute to coarsening resistance.

EXAMPLE 2

Nanocrystalline materials composed of copper, silicon, and oxygen were produced. In this instance, copper and silicon are evaporated simultaneously in a controlled mixture of helium and oxygen, such that the partial pressure of oxygen is sufficient to oxidize the silicon but not the copper.

Gas condensation in a mixture of inert and reactive gases is a novel process, as is the idea of selective oxidation of one component when evaporating multiple components. In general, at least one of the phases will have grain sizes of between 1 nm and 100 nm. More commonly, all metal and oxide phases are to exhibit such nanoscale (1–100 nm) grain sizes. In this instance, the resulting samples contain nanocrystalline copper and nanocrystalline oxidized silicon.

While increased Si solubility in Cu is an advantage to the invention, the materials made by the invented process are not dependent on silicon solubility in Cu. Thus, the inventors can fabricate Cu—$SiO_x$ nano-composites such that the $SiO_x$ phase accounts for any (0–100) weight percentage. Traditional internal oxidation treatments will only allow for an oxide concentration of not more than about 15 weight percent for this system. For other systems, the upper limit on minority phase concentration can be even lower when prepared via internal oxidation.

These materials have great technological potential due to composite reinforcement strengthening. Hard particles (the oxide) in a softer matrix (the metal) resist dislocation motion in materials. Since dislocation motion is associated with deformation in metals, hard particles can make metals harder and stronger. Also, demands for new materials often call for maintenance of good mechanical properties at high- or elevated temperatures. Many enhanced properties are due to a specific grain size and grain structure. Since higher temperatures and/or high deformation encourage grain growth, recrystallization, and modification of grain size, resistance to these internal changes is desirable. Hard-phase reinforcements retard grain growth.

For example, fine-grained, multiphase materials can exhibit superplastic deformation at certain temperatures and strain rates. Such materials are able to be deformed to strains as high as 6000 percent, far larger than for typical deformation processes. Such properties are crucial for advanced formation of many airplane parts that must be light and strong. Many materials that hold potential for superplastic deformation are not useful because grain growth occurs during deformation. This change in structure retards superplasticity. The process described in this example holds promise as a method for creating the multiphase, nanoscale structure necessary for stable superplastic deformation.

This new processing technique is an improved alternative to the traditional internal oxidation processes for making metal-oxide composites, particularly where higher oxide concentrations are desired.

Figure 4A:
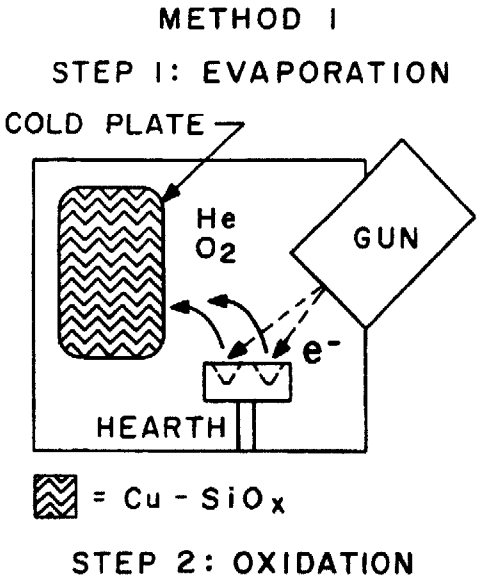
FIGS. 4A, 4B and 4C are diagrammatic illustrations of methods for making multi-component materials.
Figure 4B:
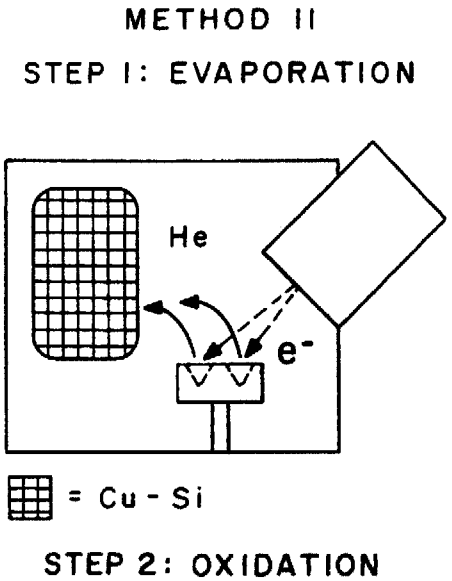
Figure 4C:
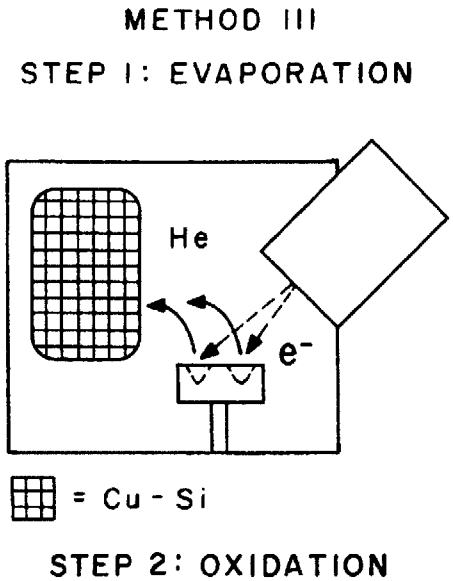

Oxidation of one of the components (e.g. Si) is achieved by the introduction of a controlled partial pressure of oxygen into the system during the evaporation. Since Si is expected to oxidize at oxygen partial pressures of $10^{-6}$ torr or less, $10^{-6}$ torr was the lower limit on the oxygen partial pressure. Pressures higher than $10^{-3}$ torr will oxidize the copper, which is not desired. A precision leak valve is used to introduce between $5\times10^{-5}$ and $5\times10^{-4}$ torr of oxygen. This method, illustrated in FIG. 4A, can be used to selectively oxidize any component as long as the component has a greater affinity for oxygen than any components that are not to be oxidized. Another method, illustrated in FIG. 4B, for oxidizing the second phase comprises first collecting the nanoparticles on the cold finger, and then allowing the optimum partial pressure of oxygen into the system. Yet another oxidizing method is incorporating a traditional internal oxidation treatment whereby nanocrystalline powders such as Cu and Si, first collected on a cold plate are compacted into a disc, with said disc then embedded into a Cu—$Cu_2O$ substrate to be heated in an inert atmosphere. This internal oxidation method is illustrated in FIG. 4C.

Higher oxide concentrations are technologically useful for purposes of increasing strength and hardness. Also, as the oxide concentration approaches 50 volume percent, cermet strengthening begins to take effect. Grain sizes for consolidated Cu—$SiO_x$ samples were 16–20 nm as calculated by analyzing peak broadening from high angle x-ray diffraction experiments. Grain sizes for unconsolidated powders were found to lie in the 5–20 nm range as measured by transmission electron microscopy in both bright- and dark-field modes.

The silicon content was measured to be 5–8 weight percent by EDS. Since the EDS detector has a thin window, oxygen is detectable. The oxygen concentration was found to be 11–13 weight percent. Since the peak positions of x-ray diffraction line scans showed only peaks of pure copper and the samples appear metallic with a copper hue, it is evident that the copper was not oxidized. The silicon oxide may be present in the amorphous state.

Hardness values averaged 2.4–2.8 GPa, larger than the 2.1–2.5 GPa of pure nanophase copper. Compositional data imply a hardness correlation with Si and O content. Sample densities were 6.8–7.6 grams/cubic centimeter. This range corresponds to 86–97 percent of the calculated theoretical values for Cu—$SiO_x$.

As with $SiO_x$, similar limited second phase concentrations have heretofore existed for many other commercially important alloy systems. The invented process provides a method to overcome these limitations, with the inventors applying their partially inert-partially reactive gas condensation technique to produce still other nanophase powders. Titanium and zirconium are other choices. The resulting oxides of Ti could be TiO, $TiO_2$, $TiO_x$, or any other stoichiometry or combination. Likewise, the resulting oxides of zirconium could be ZrO, $ZrO_2$, $ZrO_x$—$Al_2O_3$, or any other stoichiometry. In fact, any material may be used as the oxide phase in this method, as long as its affinity for oxygen is greater than that of the other metal phase. For example, $TiO_2$ or $Al_2O_3$ powders are formed by evaporating Ti or Al in 0.2 torr of oxygen. In both cases, low temperature phases (the anatase phase of $TiO_2$ and the gamma phase of $Al_2O_3$) form with a particle size of less than 5 nm. Nitrides such as $Fe_4N$, and NbN also have been prepared in this system by evaporating metals in nitrogen gas.

Likewise, any material may be used as the non-oxidize (metal) phase as long as its affinity for oxygen is less than that of the material to be oxidized. Iron, silver, and gold are all examples of metal phase possibilities.

While the invention has been described with reference to details of the illustrated embodiment, these details are not intended to limit the scope of the invention as defined in the appended claims.

The embodiment of the invention in which an exclusive property or privilege is claimed is defined as follows:

1. A method for producing a multicomponent nanocrystalline material comprising:

a). supplying a controlled atmosphere containing a reactive gas and an inert gas;

b). simultaneously vaporizing elements selected from the group consisting of titanium, iron, cobalt, nickel, copper, zirconium, palladium, silver, platinum, gold, zinc, tungsten, molybdenum, chromium, magnesium, manganese, iridium, niobium, aluminum, silicon, germanium and combinations thereof by electron beam heating in the controlled atmosphere to react selected elements with the reactive gas and thereby provide a reaction product;

(c). condensing the now mixed reaction product and elements to form a multicomponent, nanocrystalline powder;

(d). removing the powder from the controlled atmosphere; and (e). compressing the powder thereby forming a dense solid of multicomponent, nanocrystalline material.

2. The method as recited in claim 1 wherein the inert gas is selected from the group consisting of argon, helium, neon, or combinations thereof.

3. The method as recited in claim 1 wherein the controlled atmosphere contains a reactive gas selected from the group consisting of oxygen, nitrogen, hydrogen, methane, chlorine, ammonia, or combinations thereof.

4. The method as recited in claim 1 wherein the step of compressing the powder further comprises subjecting the elements to a temperature selected from a range of between approximately 25° C. and 400° C. and pressure selected from a range of between approximately 0 GPa and 10 GPa.

5. The method as recited in claim 1 wherein the controlled atmosphere contains a concentration of a gas selected from the group consisting of oxygen, nitrogen, hydrogen, methane, ammonia, chlorine, and combinations thereof said concentration determined by the amount of element having the greatest affinity for the gas thereby limiting reactivity to the gas and element.

6. The method as recited in claim 5 wherein the selected gas is oxygen selected so as to oxidize a selected element to produce an oxide, said element selected from a group consisting of titanium, iron, cobalt, nickel, zinc, zirconium, silver, tungsten, molybdenum,chromium, magnesium, manganese, iridium, niobium, copper, aluminum, silicon, germanium and combinations thereof.

7. The method as recited in claim 6 wherein the oxide is selected from the group consisting of $ZrO_2$, $Al_2O_3$, $TiO_2$, NiO, $Y_2O_3$, SiO, $SiO_2$, $Cr_2O_3$, CrO, FeO, $Fe_2O_3$, $Fe_3O_4$, MgO, ZnO, $ZrO_2$, $ZrO_2$—$Y_2O_3$, and combinations thereof.

8. The method as recited in claim 1 wherein the controlled atmosphere contains an inert gas having a pressure selected from a range of between approximately 0.1 torr to 2.0 torr.

9. The method as recited in claim 1 where the controlled atmosphere contains a reactive gas having a pressure selected from a range of between $10^{-6}$ torr and 2.0 torr.

10. The method of claim 1 wherein the nanocrystalline material produced is a composite of metal and metal oxide.

11. A method for producing a multicomponent nanocrystalline material comprising:

a). supplying a controlled atmosphere containing an inert gas selected from the group consisting of argon, helium, neon and combinations thereof;

b). simultaneously vaporizing elements selected from the group consisting of titanium, iron, cobalt, nickel, copper, zirconium, palladium, silver, platinum, gold, zinc, tungsten, molybdenum, chromium, magnesium, manganese, iridium, niobium, aluminum, silicon, germanium and combinations thereof by electron beam heating to provide a gaseous mixture wherein one or more of the vaporized elements combine to form a reaction product;

c). condensing the now mixed elements and reaction product to form a multicomponent nanocrystalline powder;

d). removing the powder from the controlled atmosphere; and e). compressing the powder thereby forming a dense solid of nanocrystalline material.

12. The method of claim 11 wherein the nanocrystalline material is a metal-intermetallic composite.

* * * * *